United States Patent [19]

Gutterman et al.

[11] Patent Number: 4,670,907

[45] Date of Patent: Jun. 9, 1987

[54] ALTERABLE WOMEN'S GARMENT

[76] Inventors: Karen S. Gutterman; Richard L. Gutterman, both of 319 Boyd Cir., Michigan City, Ind. 46360

[21] Appl. No.: 839,160

[22] Filed: Mar. 13, 1986

[51] Int. Cl.[4] ..... A41D 1/22; A41D 1/14

[52] U.S. Cl. ..... 2/105; 2/243 R; 2/221

[58] Field of Search ..... 2/275, 269, 105, 243 R, 2/221, 74, 76; 38/1 B

[56] References Cited

U.S. PATENT DOCUMENTS 2,636,180 4/1953 Gillespie et al. ..... 2/221

*Primary Examiner*—Doris L. Troutman

*Attorney, Agent, or Firm*—Thomas J. Dodd

[57] ABSTRACT

Alterable garments are formed of front and back fabric parts joined by side seams. Each fabric part includes inwardly folded material about the side seams to allow alteration of the garment.

6 Claims, 8 Drawing Figures

ALTERABLE WOMEN'S GARMENT

SUMMARY OF THE INVENTION

This invention relates to alterable garments and will have special application to women's garments such as pants, skirts, and dresses.

Heretofore, a large number of women have experienced great difficulty in purchasing clothing due to the fact that women's garments are not alterable. The non-alterable nature of women's garments has forced many women to purchase separate clothing items necessary to complete an outfit, which is more expensive for the individual and inconvenient for the retailer who must keep a certain number of sizes in stock in order to satisfy each customer.

The garments of this invention are formed of two fabric parts which approximate the size of the garment when joined at side seams. The fabric parts include an inward fold of material at the side seams which allows for rapid alteration of the garment at the bust, waist, hips, and thighs to accommodate the women who wish to purchase a complete outfit.

Accordingly, it is an object of this invention to provide an alterable garment which is for women.

Another object of this invention is to provide for an alterable women's garment which is readily altered without risk of fabric damage.

Another object of this invention is to provide for a women's garment which is alterable to fit women of many different configurations.

Other objects of this invention will become apparent upon a reading of the following description.

BRIEF DESCRIPTION OF THE DRAWINGS

Three preferred embodiments of the invention have been depicted, for illustrative purposes wherein.

DESCRIPTION OF THE PREFERRED EMBODIMENTS

The preferred embodiments herein described are not intended to be exhaustive or to limit the invention to the precise forms disclosed. They are chosen and described to explain the principles of the invention and their application and practical use to thereby enable others skilled in the art to utilize the invention.

Figure 3:
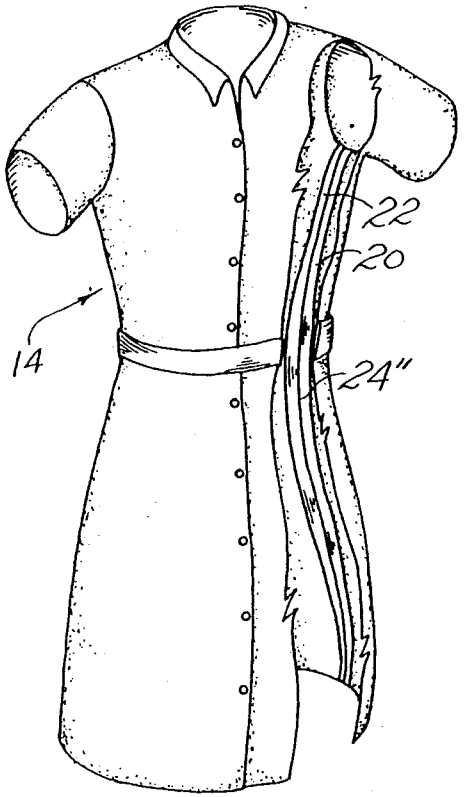
FIG. 3 is a perspective view of a dress constructed according to the principles of the invention with portions cut away for illustrative purposes.
Figure 2:
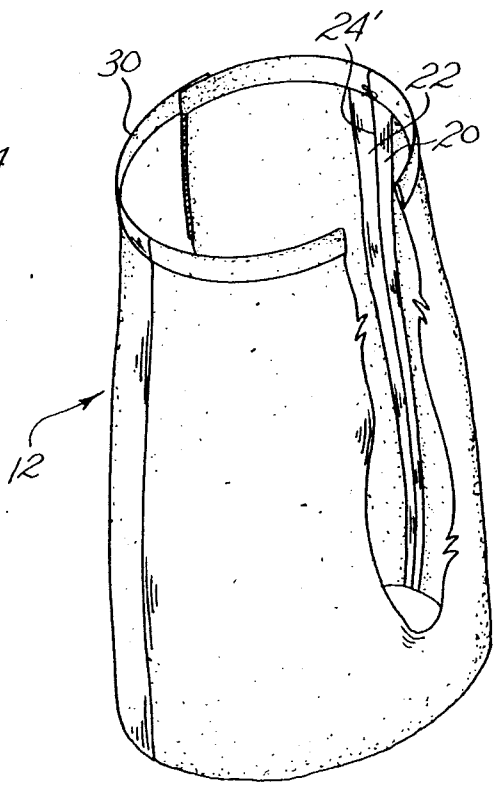
FIG. 2 is a perspective view of a skirt constructed according to the principles of this invention with portions cut away for purposes of illustration.
Figure 1:
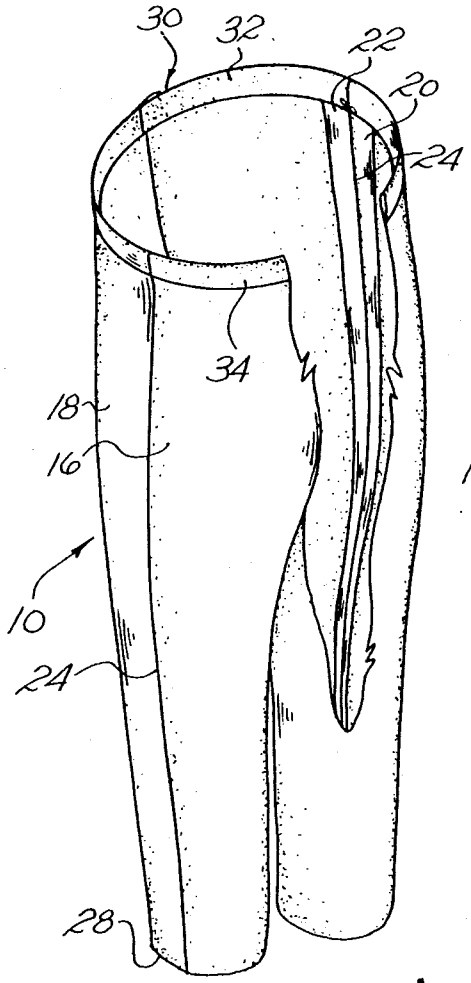
FIG. 1 is a perspective view of a pair of women's pants constructed according to the principles of this invention with portions cut away for purposes of illustration.

Referring now to the drawings, FIGS. 1 and 4–8 depict a pair of women's pants 10 constructed according to the principles of this invention. FIG. 2 depicts a skirt 12 and FIG. 3 depicts a dress 14 of the same general construction as pants 10. For purposes of simplicity, only the construction of pants 10 will be described with the understanding that the construction of skirt 12 and dress 14 is identical with the exception that the fabric parts used are of different configurations according to the style and nature of the garment.

Pants 10 are formed of two fabric parts 16 and 18 of any commercially available textile or material. For purposes of description only, fabric part 16 will be referred to as the front fabric part and fabric 18 the rear fabric part. To form fabric parts 16,18 into pants 10, a portion 20,22 of each respective part is folded inwardly from one side edge towards the other side edge. The side edges of parts 16,18 are then placed in edge-to-edge contact and connected by a side seam 24. Fold portions 20,22 may be tapered downwardly from the waist edge 26 of pants 10 towards the ankle portion 28 as shown in FIGS. 4–6.

Figure 6:
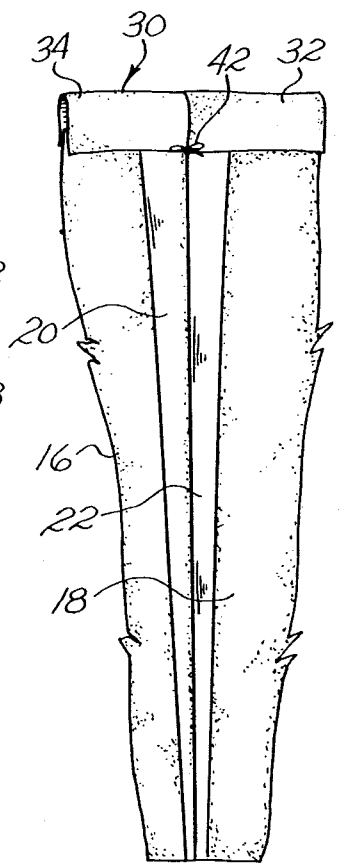
FIGS. 4–6 are sequential fragmentary elevation views showing the attachment of a waistband to the pants of FIG. 1.
Figure 5:
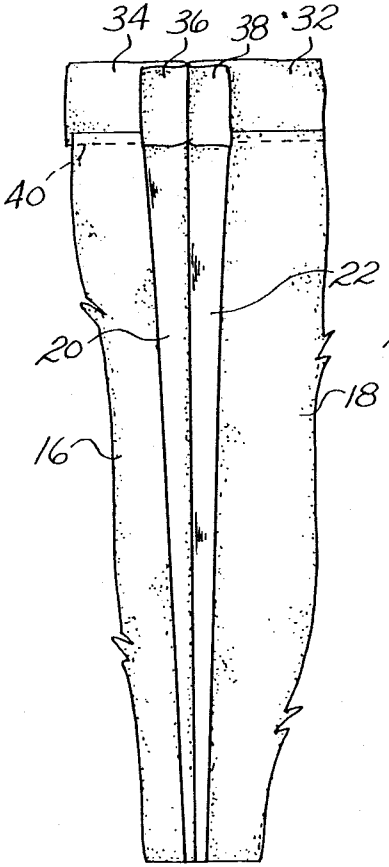
Figure 4:
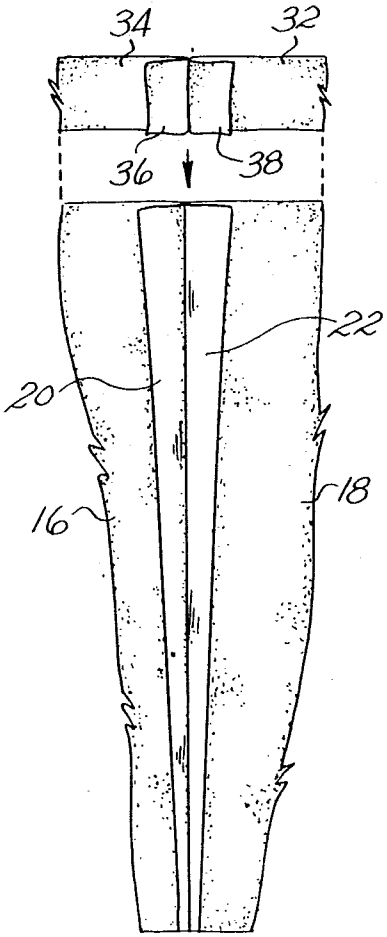

FIGS. 4–6 depict the connection of a waistband 30 to the pants 10 or to skirt 12. Waistband 30 is formed of two strips of material 32,34 each of which is folded inwardly to form folds 36,38, as in forming pant fold portions 20,22. Folds 36,38 are then aligned with folds 20,22 and the waistband 30 secured to pants 10 by a seam 40. Waistband 30 is then folded over pant waist edge 26 and loosely secured to side seam 24 by a tack stitch 42. The garment is now ready for shipment to the retailer after addition of necessary zippers, pockets, buttons,, etc. all of which are well known to those skilled in the art.

Figure 8:
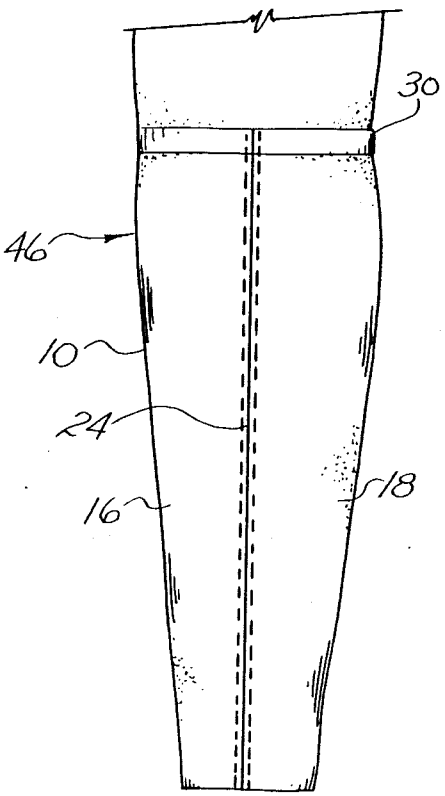
FIG. 8 is a fragmentary side elevation view of a second woman wearing the pants of FIG. 1 in an altered state.
Figure 7:
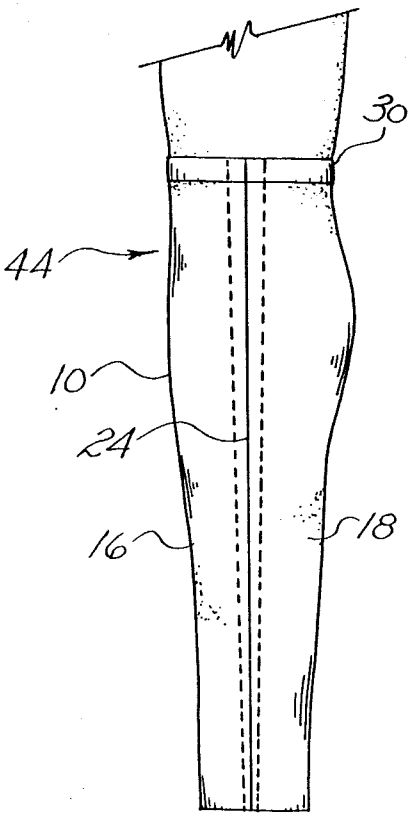
FIG. 7 is a fragmentary side elevation view of a woman wearing the pants of FIG. 1 in an unaltered state.

FIGS. 7 and 8 depict the alterability of the pants 10 along side seam 24. FIG. 7 depicts the pants 10 in their unaltered state being worn by a women whose lower body 44 is shown. FIG. 8 depicts the pants 10 after altering the side seam 24 to accommodate the woman whose lower body 46 is shown. Although not shown, it is possible that both of the women whose lower bodies 42,44 are shown wear the same size coat and/or blouse. It would then be impossible for at least one of them to purchase a complete outfit if the pants 10 were not alterable due to the different shape and size of their lower bodies.

It is understood that pants 10, skirt 12, and dress 14 may include a side seam 24,24', or 24" which runs the entire length of the garment and/or to allow alterations at several body areas such as bust, waist, hips, thighs, and calves, by simply cutting side seam 24 and altering the folds 20,22 of the garment or folds 36,38 of the waistband.

This invention is not limited to the scope of the above given details but may be modified within the scope of the appended claims.

I claim:

1. In an alterable garment which includes a first fabric part having first and second side edges, and a second fabric part having first and second side edges joined to said first fabric part side edges by seams, the improvement wherein said first fabric part first and second side edges are folded inwardly to form first opposed inner folds, and said second fabric first and second side edges are folded inwardly to form second opposed inner folds prior to joining said first and second fabric parts, wherein said garment may be selectively altered at any point along its said seams.

2. The alterable garment of claim 1 wherein the garment is a pair of women's pants.

3. The alterable garment of claim 1 wherein the garment is a skirt.

4. The alterable garment of claim 1 wherein the garment is a dress.

5. The alterable garment of claim 2 and a waistband which includes a strip of material slightly greater than the circumference of a waist opening defined by said pants, said waistband joined to said garment by a top seam.

6. The alterable garment of claim 5 wherein said waistband includes first and second fabric parts joined at a side edge of the waistband by side seams, one of said waistband first and second fabric parts having excess material folded inwardly about said waistband side seams, said waistband side seams aligned with said garment side seams when the waistband is joined to the garment.

* * * * *